United States Patent [19]

Wilson

[11] 4,453,886

[45] Jun. 12, 1984

[54] CENTRIFUGAL VENTURI

[76] Inventor: Elwin R. Wilson, 10130 SE. Cresthill Rd., Portland, Oreg. 97266

[21] Appl. No.: 260,119

[22] Filed: May 4, 1981

Related U.S. Application Data

[63] Continuation-in-part of Ser. No. 11,535, Feb. 12, 1979, abandoned.

[51] Int. Cl.[3] ..... F04D 29/30; F04D 17/14

[52] U.S. Cl. ..... 415/83; 415/211

[58] Field of Search ..... 415/60, 62, 63, 64, 415/65, 66, 69, 77, 83–87, 211; 416/179

[56] References Cited

U.S. PATENT DOCUMENTS 785,802 3/1905 Drummond ..... 415/63 X 3,369,737 2/1968 Switzer et al. ..... 415/87

FOREIGN PATENT DOCUMENTS 1069643 7/1954 France ..... 415/83

*Primary Examiner*—Stephen Marcus

*Assistant Examiner*—Joseph M. Pitko

*Attorney, Agent, or Firm*—Klarquist, Sparkman, Campbell, Leigh & Whinston

[57] ABSTRACT

A centrifugal pump-compressor includes a chamber adapted to rotate about a predetermined axis and vanes extending radially with respect to such axis and adapted to impel a fluid at least in the radial direction of the chamber. The vanes induce a primary flow of the fluid in the chamber. The apparatus further includes a series of venturis disposed in the chamber and adapted to receive the primary flow therethrough. The outwardly disposed venturis generally overlap the immediate adjacent inwardly disposed ones. A diffusing sink is positioned between the venturis. The primary flow of fluid is accelerated as it passes through each of the venturis, its velocity then decreases and the pressure in the fluid increases in each of the diffusing sinks. In this manner the energy of the fluid is converted successively from kinetic to potential forms as it moves outwardly through the chamber. Additional vanes are disposed within the chamber to increase the circumferential velocity of the fluid as it enters the several diffusing sinks.

9 Claims, 13 Drawing Figures

FIG. 1
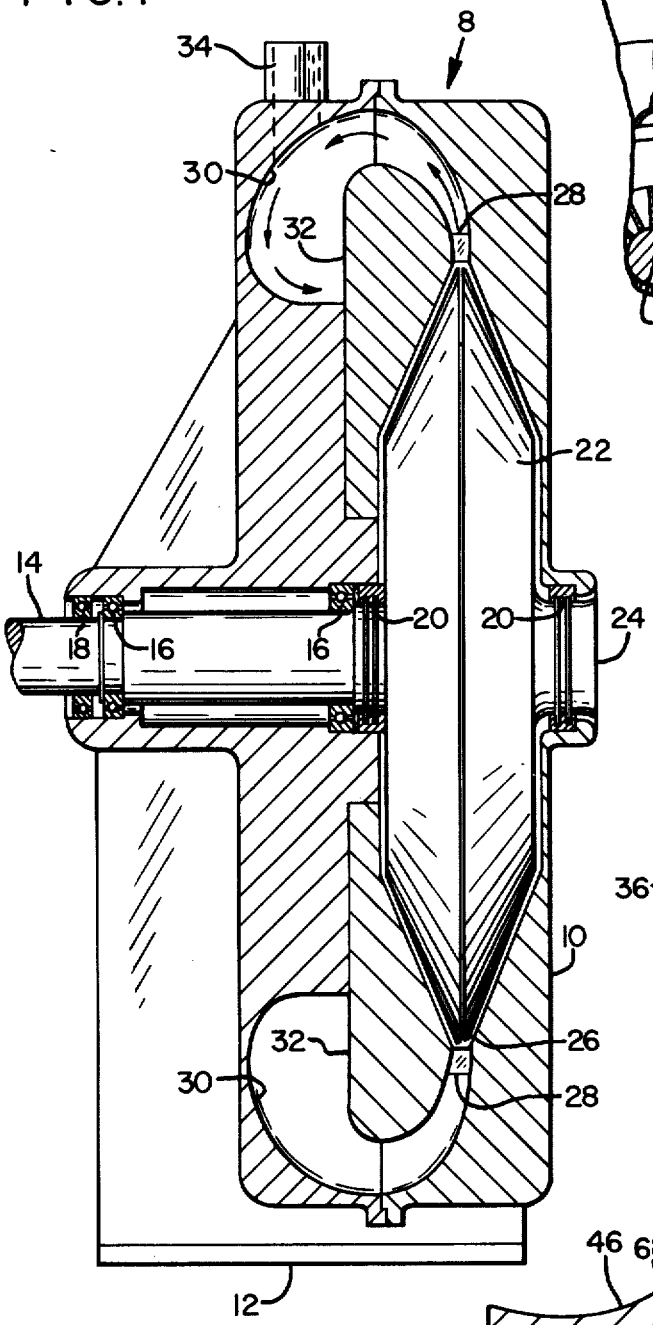
FIG. 3
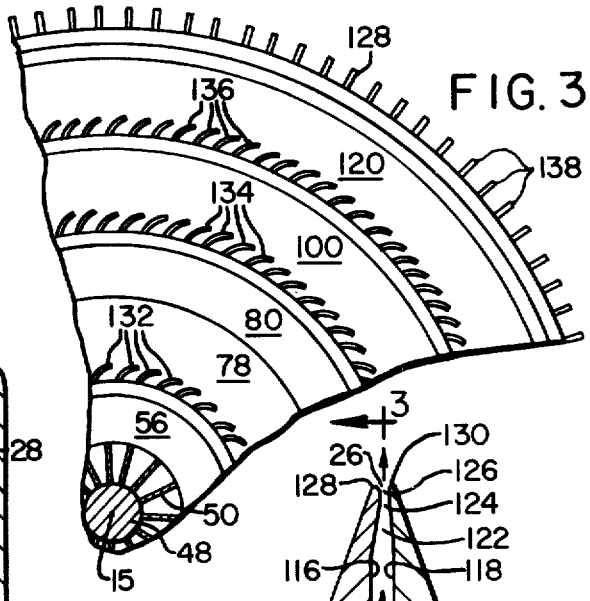
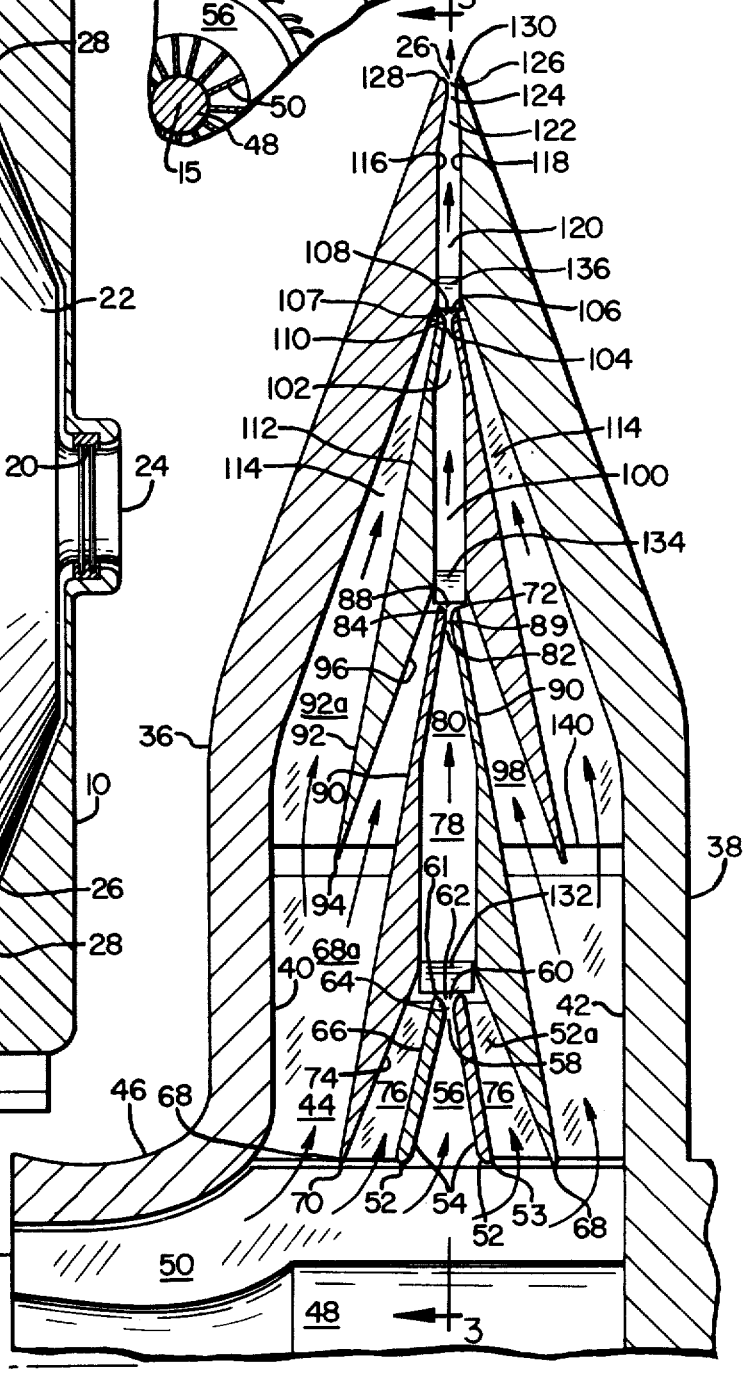
FIG. 2

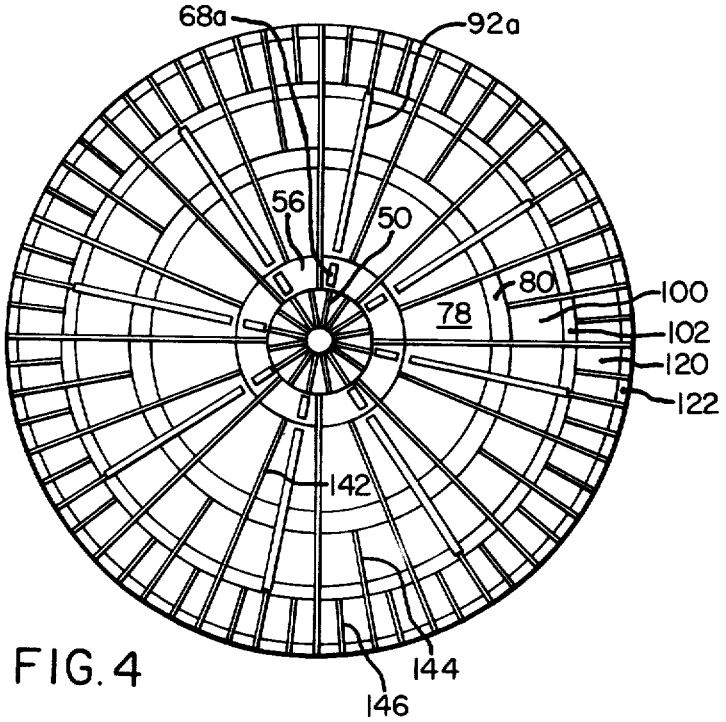
FIG. 4
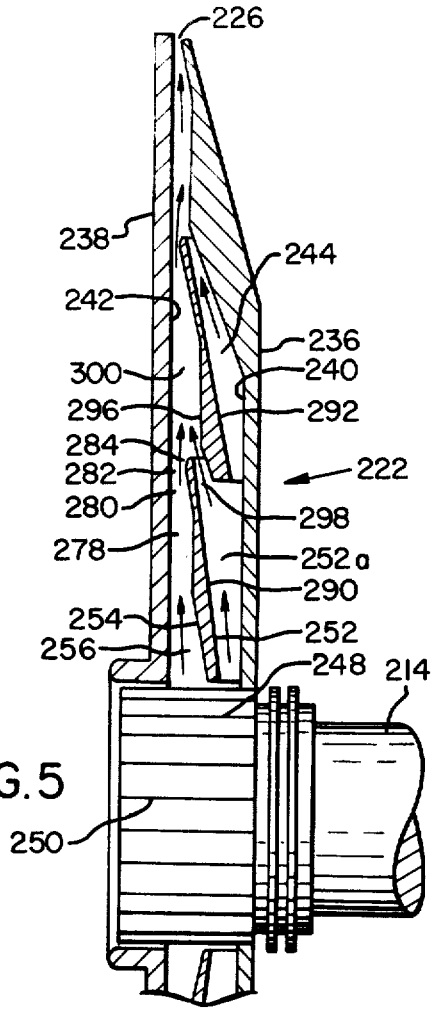
FIG. 5
FIG. 7
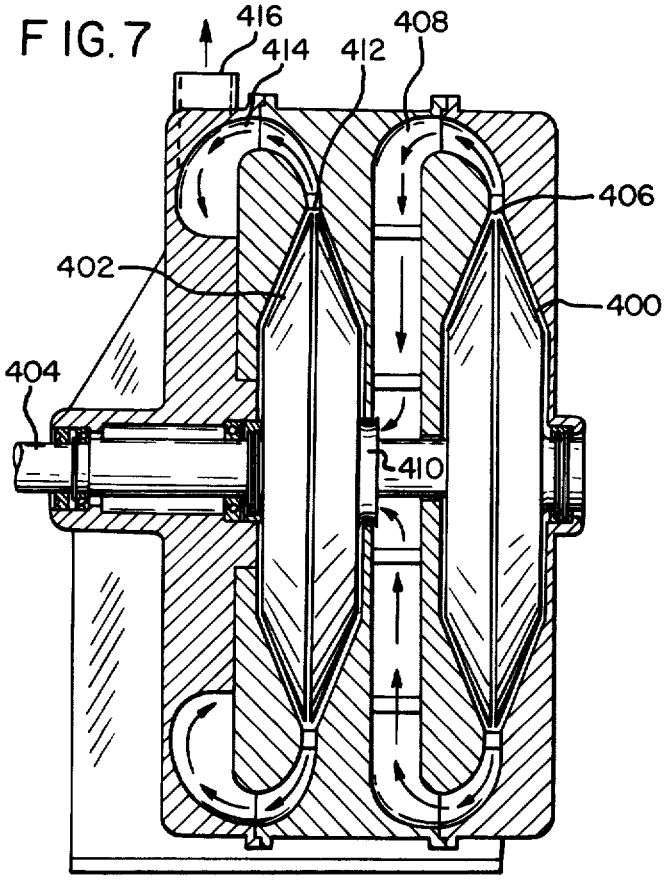
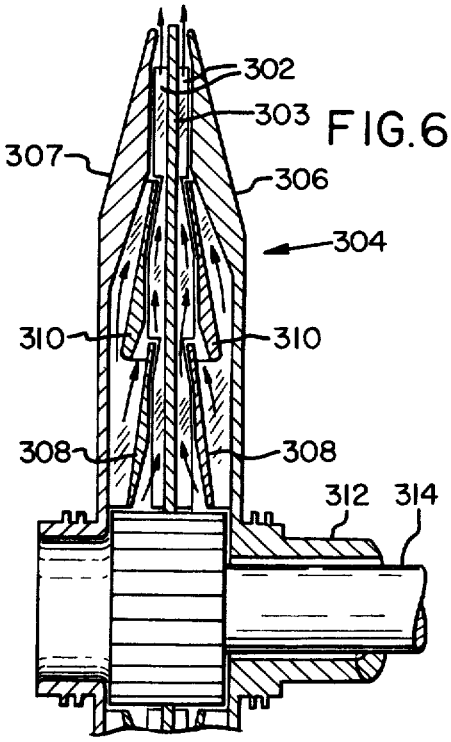
FIG. 6

CENTRIFUGAL VENTURI

CROSS REFERENCE TO RELATED APPLICATION

This is a continuation-in-part of my prior copending application Ser. No. 011,535, filed Feb. 12, 1979, and now abandoned.

BACKGROUND OF THE INVENTION

This invention relates to centrifugal pumps and compressors and, more particularly, to such devices utilizing a plurality of venturis and diffusing sinks between the venturis.

Centrifugal pumps and compressors heretofore available have been very inefficient. Fluid flow through them has been generally highly turbulent and plagued with eddy currents caused by fluid recirculation in the radially outwardly disposed areas. The devices have been unable to discharge a full fluid jet along their entire peripheral edges. Multiple stages, developing high-friction Reynolds number flows, have been required to achieve even modest amounts of compression. This, plus the power loss through heat generation, has rendered centrifugaltype pumps and compressors very inefficient compared to more conventional positive displacement devices, such as pistons, vanes, rotary screws and the like.

Conventional pumps and compressors of the centrifugal type also suffer from recirculation and by-pass problems. It has been my experience that if one is minimized, the other is made more critical. Prior devices have not been able to solve both.

Prior devices have also been inefficient when handling gases due to the substantial heat generation which accompanies gas compression.

I am aware of the following patented devices, but all are subject to the above inadequacies:

| | | |
|---|---|---|
| 851,886 | Hoover | April 30, 1907 |
| 2,737,898 | Andermatt et al | March 13, 1956 |
| 3,032,988 | Kleckner | May 8, 1962 |
| 3,282,560 | Kleckner | Nov. 1, 1966 |
| 3,547,554 | Willette | Dec. 15, 1970 |
| 3,748,058 | Bouiller et al | July 24, 1973 |
| 3,758,223 | Eskeli | Sept. 11, 1973 |

It is thus a principal object of the present invention to provide a centrifugal-type pump or compressor which will avoid recirculation and by-pass problems that have plagued prior devices.

It is a further object of the present invention to provide a high-efficiency device of the above type which will not require any high friction, close tolerance mating surfaces that are costly to manufacture, maintain and which require contaminating lubrication.

It is a still further object of the present invention to provide a pump or compressor of the above type that will exhibit reduced energy losses by eliminating eddy currents and high Reynolds number turbulent flow along with high friction mating surfaces.

It is a still further object of the present invention to provide a centrifugal-type pump or compressor which will develop a completely filled exit orifice along its entire peripheral edge, thus to discharge a full jet of fluid along the entire peripheral edge and which jet will be of uniform volume and pressure.

It is a further object of the present invention to provide such pump or compressor having greatly reduced eddy currents and turbulence throughout its entire fluid flow passage and specifically, having greatly reduced eddy currents in the region of its peripheral edge, thereby to provide for increased efficiency.

It is a still further object of the present invention to provide a pump or compressor of the foregoing type in which additional fluid may be introduced at progressively radially outwardly disposed points throughout its pumping or compressing chamber to compensate for the increase in cross-sectional area due to the increasing circumference and also to compensate for the reduction in volume due to the compression of the fluid. It should be noted, however, that the invention does not necessarily require the introduction of additional fluid in order to achieve a completely filled exit orifice.

It is a still further object of the present invention to provide a centrifugal pump or compressor in which the fluid energy is converted from kinetic to potential forms serially as it passes throughout the pump-compressor chamber, thereby to increase the pressure obtained at the discharge point.

It is a still further object of the present invention to provide a centrifugal pump or compressor in which additional reactor turbine vanes may be incorporated at selected points downstream from the point of fluid introduction and at which selected points, additional fluid may be provided for each such additional vane.

It is a still further object of the present invention to provide a centrifugal-type pump or compressor that may be used in multiple stages, wherein each successive device can utilize fluid discharged from a prior device to achieve highpressure requirements.

It is a still further object of the present invention to provide a pump or compressor of the foregoing type that will provide diffusing regions wherein liquids may be diffused into gases and any residual liquid not so diffused will be finely atomized without agglomeration while the gas is being compressed.

It is a still further object of the present invention to provide a pump or compressor of the foregoing type that can vary the volume and pressure of a compressible fluid at any given RPM while maintaining a given pressure range or conversely, vary the RPM while maintaining a given volume and pressure range. Volume and pressure in the instant invention can be maintained at any given RPM by increasing or decreasing the width or opening of the fluid flow passage.

SUMMARY OF THE INVENTION

The apparatus of the instant invention includes chamber forming means adapted to rotate about a predetermined axis and form a chamber and vane means extending radially with respect to such axis and adapted to impel a fluid at least in the radial direction of the chamber, the vane means inducing a primary flow of such fluid through the chamber.

The apparatus further includes a plurality of venturi means (two or more) disposed in the chamber and adapted to receive the primary flow, the primary flow being accelerated and subsequently decelerated as it passes through the venturi means, the venturi means being disposed serially outwardly in the chamber in the direction of the primary flow.

The invention further comprises a diffusing sink positioned between the venturi means for receiving fluid passing therethrough, the fluid passing through a venturi means being decelerated in the immediately outwardly positioned diffusing sink.

Preferably, the invention provides that each subsequent venturi means overlaps each immediately inwardly-disposed adjacent venturi means to form a channel therewith, the increased velocity of the fluid as it passes through each such venturi means inducing additional flow through said channel, such additional fluid flowing into the diffusing sink. Such additional fluid is induced to flow through the channels by the decreased pressure caused by the venturis. Such flow augments that discharged by the venturis into the immediately outwardly disposed diffusing sinks, thereby to compensate for the continually increasing cross-sectional area and the decrease in volume caused by the compression of the fluid.

The several venturi means are positioned serially outwardly of each other in the direction of primary flow through the chamber means, thereby forming a plurality of venturis at selected points outwardly of the point of fluid introduction.

The invention may further comprise additional vanes disposed in the chamber means in the direction of primary fluid flow to increase the circumferential velocity of the fluid as it enters each of the diffusing sinks.

BRIEF DESCRIPTION OF THE DRAWINGS

FIG. 1 is a side elevational view, partly in section, of a device utilizing the present invention.

FIG. 2 is a cross-sectional view to an enlarged scale of the centrifugal pump or compressor of the device illustrated in FIG. 1.

FIG. 3 is a partial sectional view taken on line 3—3 of FIG. 2.

FIG. 4 is a view similar to FIG. 3 illustrating a different configuration for the vane means.

FIG. 5 is a cross-sectional view of a different embodiment of the invention.

FIG. 6 is a cross-sectional view of a still additional embodiment of the invention.

FIG. 7 is a cross-sectional view of a multiple stage, pump or compressor utilizing the instant invention.

DESCRIPTION OF THE PREFERRED EMBODIMENTS

Figure 10:
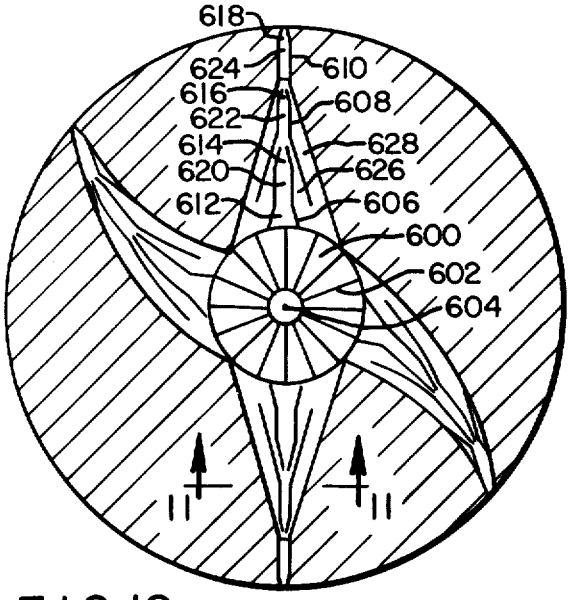
FIG. 10 is a schematic view similar to FIG. 3 illustrating a still additional embodiment of the present invention.

Referring to the drawings and specifically, to FIGS. 1-3, one embodiment of the invention is illustrated in the form of a centrifugal compressor 8 which includes a housing 10 mounted on a base 12 powered by an input shaft 14 having an axis 15 rotatable in bearings 16 and provided with an input shaft seal 18 and positive air seals 20 on opposite sides of an internal closed impeller assembly 22 having an air inlet 24, as shown. Air compressed by the assembly 22 is discharged fully around its peripheral orifice 26, flowing radially along a diffuser impeller 28, thence being discharged into a diffuser scroll 30 provided with a parallel wall plate 32 to discharge through an outlet pipe 34. Diffuser impeller 28 may be stationary or it may be powered in either direction.

The impeller assembly 22 is more particularly disclosed in FIG. 2 which illustrates its cross-section. As shown, the assembly is mounted in the housing 10 and powered by the shaft 14. More particularly, it comprises two coaxial disks 36, 38 which form a pair of concentric axially spaced walls having opposed inner faces 40, 42 which cooperate to form a compressing chamber 44. Disk 36 is curved at its inner end 46 to form air inlet 24. The disks 36, 38 are axially spaced further apart at their inner ends, converging toward each other in the radially outward direction to form the impeller orifice 26, as shown. An induction impeller 48 comprising eight pairs of axially positioned vanes 50 is attached to the disks 36, 38 for rotation by shaft 14. Vanes 50 extend radially outwardly from axis 15 only in the region of the inner ends of the disks 36, 38, as shown.

A first pair of annular plates 52 are positioned interiorly of chamber 44 radially immediately outward of the vanes 50 in the region of the inner end 46 of disk 36. Plates 52 are disposed generally parallel to disks 36, 38. Their inner surfaces 54 first converge toward each other to form an annular choke section 56, then form a throat 58 and finally, diverge from each other in the radially outward direction to form a pressure-restoring region 60 terminating at their outer edges 61 in a peripheral orifice 62, thereby to form an annular venturi 64 whose inlet is in communication with air inlet 24. The exterior surfaces 66 also converge towards each other in the radially outward direction as shown.

A second pair of annular plates 68 also generally parallel to the disks 36, 38, are positioned axially outwardly of plates 52. The inner edges 70 of plates 68 are generally in register with the inner edges 53 of plates 52, however, the outer edges 72 of plates 68 extend considerably radially outwardly of plates 52, generally radially centrally of chamber 44, as shown.

The inner surfaces 74 of plates 68 converge toward each other in the region of the plates 52, that is, in the region of overlap, to form a pair of annular passageways or channels 76 which converge in the radially outwardly direction of the chamber 44, as shown. Commencing at the outer edges 61 of plates 52, the inner surfaces 74 of plates 68 extend generally parallel to each other in the radially outward direction to form a first annular diffusing sink 78, whereupon the inner surfaces 74 continue to converge to form a second choke section 80, the inner surfaces 74 thereafter extending parallel to each other to form a second throat 82, the surfaces 74 thereafter diverging in the radially outwardly direction to form a second pressure-restoring region 84 and forming at their outer edges 72 a second annular orifice 88, as shown. As such the outer portions of plates 68 form a second annular venturi 89. Again, the exterior surfaces 90 of plates 68 converge towards each other in the radially outward direction as shown.

A third pair of annular plates 92 are positioned interiorly of the chamber 44, commencing at their inner edges 94 in the generally intermediate region of sink 78, overlappinq the plates 68 in the region of the second annular venturi 89 and thereafter extending radially outwardly of plates 68 as shown.

The inner surfaces 96 of plates 92 converge in the radially outwardly direction commencing at their inner edges 94 generally to the outer edges 72 of plates 68, thus to form a second pair of annular passageways or channels 98 with the external surfaces 90 of plates 68, the inner surfaces 96 thereafter extending generally parallel to each other radially outwardly of annular orifice 88 to form a second diffusing sink 100. The inner surfaces 96 thereafter continue to converge in the radially outwardly direction to form a third choke section 102, surfaces 96 thereafter extending parallel to each other to form a third throat 104, surfaces 96 thereafter diverging to form a third pressure-restoring region 106, plates 92 terminating at their outer edges 107 to form a third annular orifice 108. Choke section 102, throat 104 and pressure-restoring region 106 combine to form a third annular venturi 110. The external surfaces 112 of plates 92 also generally converge in the radially outwardly direction of the chamber 44 to form a third pair of annular converging passageways or channels 114 with the converging inner surfaces 40, 42 of disks 36, 38, as shown.

The outermost portions 116, 118 of the inner faces 40, 42 of disks 36, 38 extend generally parallel to each other radially outwardly of annular orifice 108 to form a third diffusing sink 120, faces 40, 42 thereafter converging in the radially outwardly direction to form a fourth choke section 122, faces 40, 42 thereafter extending parallel to each other to form a fourth throat 124, surfaces 40, 42 thereafter diverging to form a fourth pressure-restoring region 126 terminating at the outboard cdgcs 128, 130 in orifice 26.

Plates 92 are supported by radially extending vanes 92*a;* plates 68 are supported by radially extending vanes 68*a;* and plates 52 are supported by radially extending vanes 52*a,* all as shown. In addition, a plurality of generally radially extending additional diffuser impellers or vanes 132, 134, 136 are positioned at the radially outward edges 61, 72, 107 of plates 52, 68, 92, respectively, vanes 132, 134, 136 furnishing additional support for plates 68, 92 and disks 36, 38, as shown. Vanes 132, 134, 136 are illustrated as curved in FIG. 3 generally in the direction of rotation of the assembly 22. They may, however, extend otherwise, as for example, radially directly outwardly, as illustrated at 138.

A set of booster impellers or vanes 140 extend axially between the inner faces 40, 42 of disks 36, 38, vanes 140 extending in the radial direction at about the center of the first diffusing sink 78.

FIG. 4 illustrates an alternative configuration for the diffusing impellers. In that embodiment radially extending vanes 142, 144, 146 are positioned as shown.

OPERATION

Rotation of shaft 14 causes induction impeller 48 to give air entering inlet 24 a radial velocity, forcing the air into first choke section 56, which causes the radial velocity to increase or accelerate as the air approaches throat 58. The increased velocity at throat 58 is accompanied by a decrease in pressure as the air passes through region 60 and approaches the inner edges of vanes 132. This primary flow through the first venturi 64 induces additional air flow in channels 76. As this air flows radially along vanes 132, its tangential velocity is increased, whereupon leaving vanes 132, the air flows into the first diffusing sink 78 which acts as a vaneless diffuser. The air flow retains its angular momentum, but decreases in radial velocity as it flows towards the second choke section 80. As the flow slows down in the radial direction, its pressure increases.

The same process repeats itself at the second annular orifice 88, the decrease in pressure caused by the second annular venturi 89 inducing an additional flow of air in channels 98.

As the air flows radially along vanes 134, again its tangential velocity is increased. Leaving vanes 134, the air flows into the second diffusing sink 100, which again acts as a vaneless diffuser. The air in sink 100 retains its angular momentum, but again decreases in radial velocity as it flows toward choke section 102. Again as the flow slows down in the radial direction, its pressure increases. As the flow exits the third annular orifice 108, the same process is repeated, the air ultimately being discharged through orifice 26.

Use of the booster vanes 140 increases tangential velocity of the flow and tends to increase the flow in channels 98 and 114.

Use of the pairs of annular venturi-forming plates in series, with diffusing sinks therebetween, results in the fluid energy being converted from kinetic to potential forms several times as the flow passes radially outwardly from the hub of the compressor to its ultimate orifice 26. The effect is to increase the ultimate pressure obtainable.

The venturi-forming plates are also useful in causing decreases in pressure at the inboard edges of vanes 32, 134, 136, thereby to cause the primary flow through the venturis 64, 89, 110 to induce flow in channels 76, 98, 114. The additional gas thereby drawn into the diffusing sinks 78, 100, 120 compensates for the increase in cross-sectional area through which the flow must pass (due to the constantly increasing circumference) and also compensates for the fact that as the gas is compressed, it takes up less volume.

The channels which are provided also serve to maintain laminar flow at the points of introduction of the additional fluid and this, together with the increased vane area provided by vanes 132, 134, 136, prevent the formation of eddy currents that would otherwise reduce the efficiency of the device.

As has been previously mentioned, the additional vanes 132, 134, 136 may be curved as illustrated in FIG. 3, or they may take other forms, e.g., radially straight, as illustrated in FIG. 4, and their introduction at the points at which the additional fluid is caused to merge with the primary flow, permits increases in tangential velocity at such points.

The introduction of the additional air at the several radially spaced points in chamber 44 enables the device to develop a full jet of air along its entire peripheral orifice 26. This jet is of uniform volume and pressure, thereby to increase the efficiency of the device and avoid the production of high Reynolds number eddy currents.

Use of the several diffusing sinks 78, 100, 120 in series permits the device to diffuse liquids into gases as necessary. Any liquids not so diffused will be finely atomized into the gas stream without agglomeration while the gas is being compressed.

The compressor can vary the volume-pressure ratio of a compressible fluid at any given RPM while maintaining a given pressure range, or conversely, it can vary thc RPM while maintaining a given volume-pressure range. Specifically, volume and pressure can be maintained at any given RPM through increasing or decreasing the size of the orifice passage.

When used as a liquid pump, the invention is selfpriming inasmuch as it has the ability to initiate a vacuum. The device can continue to pump in the event gas finds its way into the suction line. As hereinbefore mentioned, it can mix liquids with the gas so that the mixture can be effectively pumped. The device provides for improved operation with liquids at or near vapor pressure.

The design avoids many of the adverse effects caused by eddy currents, i.e., cavitation, and facilitates steady pumping performance with mixed gases and liquids. The device exhibits improved performance and stability over a wide volume range.

The device provides for equalization of fluid distribution throughout the progressively enlarging cross-sectional area (due to the continually enlarging circumference of the impeller) to provide a completely filled orifice 26 as hereinbefore mentioned. There are no recirculation vortices at or near the impeller orifice 26. Overall, the device results in improved performance, enabling the pumping of fluids at higher pressures and requiring reduced energy consumption.

Although a closed impeller 22 has been illustrated, the device is operable with either an open or a closed impeller. Also, although the several channels and sinks are illustrated as being circumferentially continuous, this is not an absolute requirement as any type of flow channels could be employed.

Simiarly, although the several diffusing sinks have been illustrated as vertically symmetrically or concentrically disposed in chamber 44, they need not be concentrically disposed with respect to the venturis, but may be eccentric or in the form of segments of a circle.

Also, whereas channels 76, 98, 114 are similarly illustrated as axially symmetrically disposed within chamber 44, they need not be so and can take various shapes.

Also, whereas the illustrated embodiment illustrates a two-dimensional generally radial flow, such need not always be annularly symmetrical, but could have axial components thus to result in oblique, conical or spiral flows.

FIG. 5 EMBODIMENT

An axially unsymmetrical embodiment is illustrated in FIG. 5. There, an impeller assembly 222 comprises two coaxial disks 236, 238, which form a pair of concentric axially spaced walls having opposed inner faces 240, 242 which cooperate to form a compressing chamber 244. Disk 236 is powered by a shaft 214, but disk 238 is stationary. As in the embodiment of FIGS. 1–4, the disks 236, 238 are axiallyspaced further apart at their inner ends, converging towards each other in the radially outward direction to form an impeller orifice 226, as shown. An induction impeller 248 comprising vanes 250 rotates with shaft 214.

A first annular plate 252 is positioned interiorly of chamber 244 radially immediately outward of the vanes 250 in the region of the inner end of disk 236 and is supported by radially extending vane 252*a*. Plate 252 is disposed generally parallel to disks 236, 238. The inner surface 254 of plate 252 first converges toward disk 238 to form an annular choke section 256 and then extends generally parallel to disk 238 to form an annular diffusing sink 278, whereupon the inner surface 254 continues to converge to form a second choke section 280, the inner surface 254 thereafter extending parallel to disk 238 to form a throat 282, the surface 254 thereafter diverging in the radially outwardly direction to form a pressure-restoring region 284, as shown.

A second annular plate 292 is positioned interiorly of the chamber 244 overlapping the plate 252 in the region of the choke section 280 and thereafter extending radially outwardly as shown. The inner surface 296 of plate 292 first converges toward disk 238 in the radially outwardly direction to form an annular passageway or channel 298 with the external surface 290 of plate 252, the inner surface 296 thereafter extending generally parallel to disk 238 to form a second diffusing sink 300. It can thus be seen that although the FIG. 5 embodiment is not axially symmetrical in that pairs of annular plates are not used, its function is the same as the embodiment illustrated in FIGS. 1–3.

FIG. 6 EMBODIMENT

FIG. 6 illustrates an embodiment of the invention wherein pairs of symmetrically disposed radial vanes 302 mounted on a plate 303 extend radially the full length of the impeller 304 and rotate at a different speed and/or direction from the impeller 304 itself. As such, the impeller 304, comprising two coaxial disks 306, 307 and provided with overlapping pairs of annular plates 308, 310, is rotated by a hollow shaft 312, as shown.

The pairs of radially extending vanes 302 are themselves powered by a shaft 314 extending coaxially with shaft 312 and positioned interiorly thereof. The vanes 302 may rotate at a different speed from thc disks 306, 307 or they may even rotate, in fact, in the opposite direction. The operation of the embodiment is, however, otherwise similar to that of the embodiment illustrated in FIGS. 1–3.

FIG. 7 EMBODIMENT

Multiple Stage Impeller

FIG. 7 illustrates the invention utilized in series, wherein fluid discharged from one pump or compressor is received by another, thereby to achieve higher compression ratios and/or higher pressure requirements. Referring to the drawing, an input shaft 404 rotates impellers 400, 402 such that fluid compressed by impeller 400 and discharged fully around its peripheral orifice 406 is discharged into a diffuser scroll 408 and thence enters an air inlet 410 of a second impeller 402 for additional compression. Fluid compressed by the impeller 402 is discharged fully around its peripheral orifice 412, being discharged into a diffuser scroll 414 to discharge through an outlet pipe 416.

AXIAL FLOW EMBODIMENTS

Figure 8:
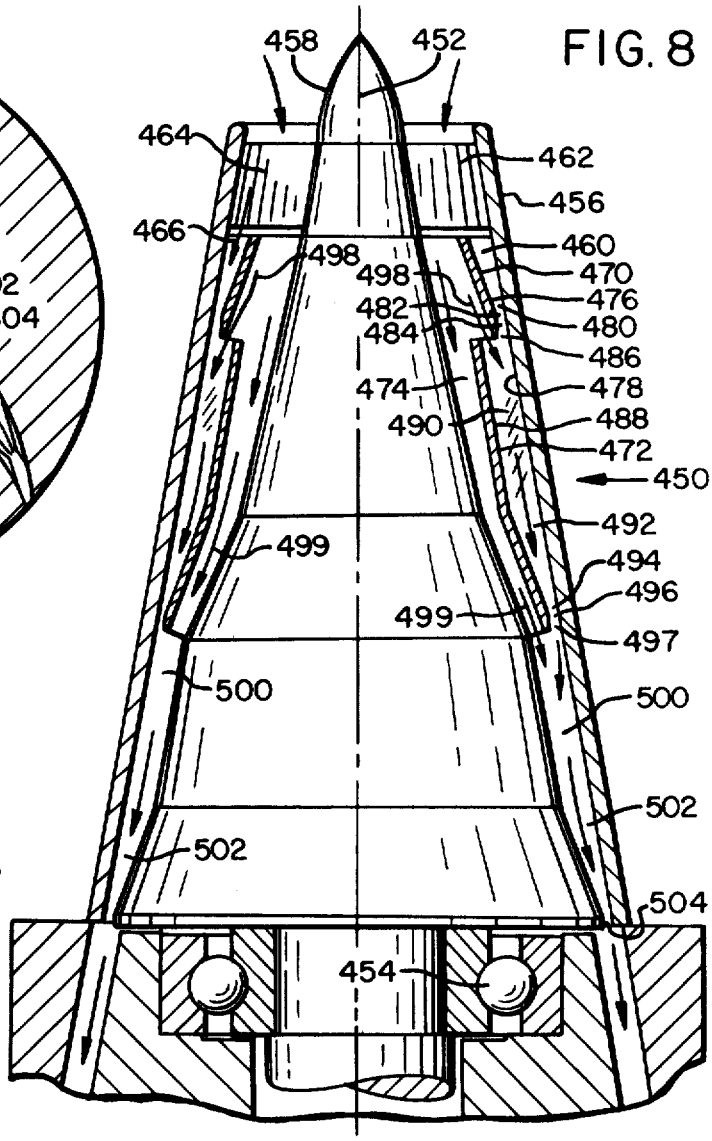
FIG. 8 is a cross-sectional view of an axial flow embodiment of the present invention.
Figure 9:
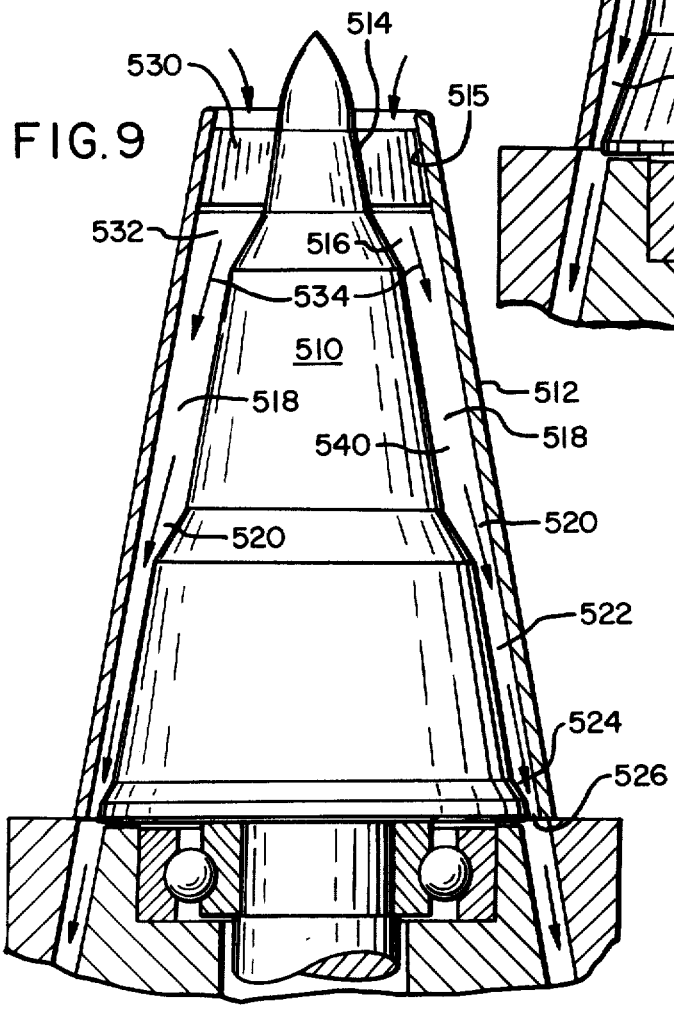
FIG. 9 is a cross-sectional view of a still additional axial flow embodiment of the present invention.

FIGS. 8 and 9

FIGS. 8 and 9 illustrate axial flow embodiments of the instant invention as, for example, might be utilized in jet turbine engines. Referring to FIG. 8, the invention is illustrated in the form of a jet engine 450 having an axis 452 and rotatable in bearings 454. A housing 456 and core structure 458 cooperate to form an annular chamber 460. An induction impeller 462 comprising multiple pairs of radially extending vanes 464 is attached to the core structure 458 for rotation therewith. Impeller 462 impels a fluid radially of chamber 460 and, together with the conical shape of housing 456, induces a primary flow of fluid through chamber 460 in the direction of the arrows 466.

Frustoconical venturi-forming annular sleeves 470, 472 supported by radially extending vanes 474 are positioned interiorly of chamber 460 to receive the flow of fluid as it passes through the chamber. The outer surface 476 of sleeve 470 first converges toward the inner surface 478 of housing 456 to form an annular choke section 480, then forms a throat 482 and finally, diverges from surface 478 to form a pressure-restoring region 484, thereby to form an annular venturi 486 whose inlet is in communication with impeller 462.

The second sleeve 472 is positioned outwardly of sleeve 470 in the direction of flow through chamber 460. Its outer surface 488 extends generally parallel to the inner surface 478 of housing 456 to form a first annular diffusing sink 490, whereupon the surface 488 thereupon converges with respect to housing 456 to form a second choke section 492, the surface 488 thereafter extending parallel to surface 478 to form a second throat 494, surface 488 thereafter diverging from surface 478 to form a second pressure-restoring region 496, thereby forming a second annular venturi 497.

Rotation of the core structure 458 causes induction impeller 462 to give air entering housing 456 a radial velocity, which together with the frustoconical shape of housing 456, induces a flow of fluid through chamber 460 as hereinbefore described. The flow is accelerated as it passes through throat 482, the increased velocity being accompanied by a decrease in pressure as the air passes through venturi 486. This primary flow through tne venturi 486 induces an additional fluid flow (arrows 498) interiorly of sleeve 470. As this fluid flows along supporting vanes 474, its circumferential or tangential velocity is increased, and it flows into the first diffusing sink 490 wherein its pressure increases.

The same process repeats itself at the second venturi 497, the decrease in pressure inducing an additional flow of air interiorly of sleeve 472 (arrows 499).

The core structure itself is formed parallel to housing 456 downstream of sleeve 472 to form a second diffusing sink 500. The fluid in sink 500 retains its angular momentum, but again decreases in radial velocity as it flows towards a third choke section 502 formed by convergence of core structure 458 with respect to housing 456, as shown. Ultimately, the flow exits through an annular orifice 504.

FIG. 9 illustrates an axial flow embodiment generally similar to that illustrated in FIG. 8, but wherein a generally conical core structure 510 is designed itself to form the required choke sections and diffusing sinks with respect to the interior of housing 512 without the provision of any annular sleeves. As shown, the exterior surface 514 of core structure 510 first converges toward the inner surface 515 of housing 512 to form an annular choke section 516. Surface 514 thereafter extends generally parallel to surface 515 to form a first diffusing sink 518, whereupon surface 514 again converges towards surface 515 to form a second annular choke section 520. Surface 514 again extends parallel to surface 515 to form a second diffusing sink 522, whereupon surface 514 again converges to form a third annular choke section 524, finally terminating in a peripheral orifice 526, as shown.

Rotation of the core structure 510 and its attached induction impeller 530 impel fluid entering the engine in the radial direction, the frustoconical shape of housing 512 inducing a primary flow of fluid through the chamber 532 in the direction of the arrows 534. The flow is accelerated as it passes through choke section 516 until it passes into diffuser 518, wherein its kinetic energy is converted to potential energy with a corresponding pressure increase. The same process repeats itself at the successive choke sections and vaneless diffusers until discharge at orifice 526.

The embodiment illustrated in FIG. 9 does not utilize any additional air drawn in by the venturi action. Vanes 540 extending between core structure 510 and housing 512 increase the circumferential or tangential velocity of the flow and tend to increase the primary flow.

FIG. 10 EMBODIMENT

FIG. 10 illustrates an embodiment of the invention including a series of venturis overlapping in the radial direction thereof. As shown, an induction impeller 600 comprising pairs of radially extending vanes 602 rotates about an axis 604 to impel a fluid entering the impeller in the radial direction. The flow is induced through a series of frustoconical venturis 606, 608, 610 which overlap each other as shown. A series of choke sections 612, 614, 616, 618 are formed with diffusing sinks 620, 622, 624 therebetween. The conical venturis 606, 608, 610 overlap each other to form annular channels 626, 628, through which channels additional fluid is induced to flow by the decreased pressure caused by the venturis. Such flow augments that discharged by the venturis into the immediately outwardly diffusing sinks 622, 624, thereby to compensate for decrease in fluid volume caused by compression.

Figure 11A:
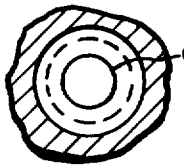
FIGS. 11*a*, 11*b* and 11*c* are optional cross-sectional configurations taken on line 11—11 of FIG. 10.
Figure 11B:
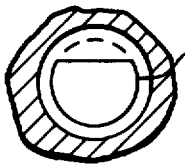
Figure 11C:
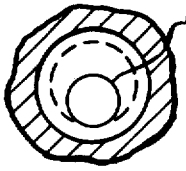

FIG. 11*a* illustrates that the cross-sectional shape of the venturis 606, 608, 610 may be vertically or axially symmetrical. FIG. 11*b* illustrates that the same may take the form of a segment of a circle. FIG. 11*c* illustrates that the axial orientation may be eccentric.

As hereinbefore mentioned, the generally radially extending vanes may be of various lengths or shapes, such as air foil, backwardly inclined, curved, radial, forwardly curved, axial or combinations of such shapes.

A partial list of end uses for the invention is as follows:

1. An air compressor for gas turbine engines;
2. An air compressor for jet turbine engines;
3. A supercharger for piston-type engines, gasoline or Diesel;
4. Industrial and commercial air compressors;
5. Industrial and commercial high-pressure blowers;
6. Cryogenic compressors;
7. Vacuum pump applications;
8. High-pressure liquid pump applications.

While it will be apparent that the preferred embodiments of the invention herein disclosed and illustrated are well calculated to fulfill the objects above-stated, it will be appreciated that the invention is susceptible to modification, variation and change.

I claim:

1. A centrifugal pump-compressor for fluids, comprising:

chamber forming means adapted to rotate about a predetermined axis and form a chamber;

vane means extending radially with respect to said axis and adapted to impel a fluid at least in the radial direction of said chamber, said vane means inducing a primary flow of said fluid through said chamber;

a plurality of venturi means disposed in said chamber and adapted to receive said primary flow, said primary flow being accelerated and subsequently decelerated as it passes through said venturi means, said venturi means being disposed serially outwardly of said chamber means in the direction of said primary flow;

a diffusing sink positioned intermediate adjacent venturi means for receiving fluid passing therethrough, said fluid passing through each said venturi means being decelerated in the immediately outwardly adjacent diffusing sink, whereby the energy of said fluid is converted successively from kinetic to potential forms as it passes through said chamber; and said venturi means overlapping to form a channel therebetween, the increased velocity of said fluid as it passes through said venturi means inducing additional fluid to flow through said channel, said additional fluid flowing into said diffusing sink.

2. A centrifugal pump-compressor for fluids as in claim 1, in which said venturi means comprise frustoconical venturis.

3. A centrifugal pump-compressor for fluids, comprising:

chamber forming means adapted to rotate about a predetermined axis and form a chamber;

vane means extending radially with respect to said axis and adapted to impel a fluid at least in the radial direction of said chamber, said vane means inducing a primary flow of said fluid through said chamber;

a plurality of venturi means disposed in said chamber and adapted to receive said primary flow, said primary flow being accelerated and subsequently decelerated as it passes through said venturi means, said venturi means being disposed serially outwardly of said chamber means in the direction of said primary flow;

a diffusing sink positioned intermediate adjacent venturi means for receiving fluid passing therethrough, said fluid passing through each said venturi means being decelerated in the immediately outwardly adjacent diffusing sink, whereby the energy of said fluid is converted successively from kinetic to potential forms as it passes through said chamber; and said chamber means comprising a pair of concentric axially spaced walls having opposed inner surfaces cooperating to form said chamber, one of said walls having a central inlet opening to said chamber and at least one of said walls being rotatable.

4. A centrifugal pump-compressor for fluids as in claim 3, in which said vane means comprise at least one pair of central vanes extending axially from one of said walls to the other, said vanes radiating outwardly from said inlet opening.

5. A centrifugal pump-compressor for fluids as in claim 4, in which said central vanes are attached to said rotatable wall to rotate therewith.

6. A centrifugal pump-compressor for fluids as in claim 3, in which said venturi means comprise at least one annular plate disposed interiorly of said chamber, said plate being disposed generally parallel to said walls.

7. A centrifugal pump-compressor for fluids as in claim 3, in which said venturi means comprise at least one pair of annular plates disposed interiorly of said chamber, said plates being disposed generally parallel to said walls, the inner surfaces of said plates first converging towards each other and then diverging from each other in the radially outwardly direction of said chamber to form an annular venturi, said central inlet opening communicating with said annular venturi.

8. A centrifugal pump-compressor for fluids as in claim 7, further comprising:

a second pair of annular plates positioned axially outwardly of said one pair of annular plates and extending radially outwardly thereof, the inner surfaces of said second pair of annular plates first converging towards each other in the region of said one pair of annular plates to form a pair of annular channels exteriorly thereof, said inner surfaces of said second pair of annular plates then extending generally parallel to each other radially outwardly of said one pair of annular plates to form a diffusing sink for fluid passing through said annular venturi, the increased radial velocity of the fluid as it passes through said annular venturi inducing additional fluid to flow through said annular channels, said additional fluid flowing into said diffusing sink, the fluid passing through said venturi being radially decelerated in said diffusing sink.

9. A centrifugal pump-compressor for fluids, comprising:

chamber forming means adapted to rotate about a predetermined axis and form a chamber;

vane means extending radially with respect to said axis and adapted to impel a fluid at least in the radial direction of said chamber, said vane means inducing a primary flow of said fluid through said chamber;

a plurality of venturi means disposed in said chamber and adapted to receive said primary flow, said primary flow being accelerated and subsequently decelerated as it passes through said venturi means, said venturi means being disposed serially outwardly of said chamber means in the direction of said primary flow;

a diffusing sink positioned intermediate adjacent venturi means for receiving fluid passing therethrough, said fluid passing through each said venturi means being decelerated in the immediately outwardly adjacent diffusing sink, whereby the energy of said fluid is converted successively from kinetic to potential forms as it passes through said chamber;

said venturi means comprising frustoconical venturis; and said frustoconical venturis overlapping to form annular channels therebetween, the increased velocity of said fluid as it passes through said venturis inducing additional fluid to flow through said channels, said additional fluid flowing into said diffusing sinks.

* * * * *

UNITED STATES PATENT AND TRADEMARK OFFICE

CERTIFICATE OF CORRECTION

PATENT NO. : 4,453,886

DATED : June 12, 1984

INVENTOR(S) : ELWIN R. WILSON

It is certified that error appears in the above-identified patent and that said Letters Patent is hereby corrected as shown below:

Column 6, line 22, "32" should be --132--.

Signed and Sealed this

*Twenty-third* Day of *October 1984*

[SEAL]

*Attest:*

GERALD J. MOSSINGHOFF

*Attesting Officer*

*Commissioner of Patents and Trademarks*